US007000369B1

(12) United States Patent
Paviot

(10) Patent No.: US 7,000,369 B1
(45) Date of Patent: Feb. 21, 2006

(54) FEED ROLL FOR PACKAGE TUBING EQUIPPED WITH CUTTING AND SEALING MEANS

(75) Inventor: Alexandre Paviot, Lyons (FR)

(73) Assignee: Papiers A Paviot, Corbas (FR)

( * ) Notice: Subject to any disclaimer, the term of this patent is extended or adjusted under 35 U.S.C. 154(b) by 0 days.

(21) Appl. No.: 10/203,653

(22) PCT Filed: Mar. 7, 2001

(86) PCT No.: PCT/FR01/00678

§ 371 (c)(1),
(2), (4) Date: Aug. 26, 2002

(87) PCT Pub. No.: WO01/66415

PCT Pub. Date: Sep. 13, 2001

(30) Foreign Application Priority Data

Mar. 7, 2000 (FR) ..... 00 02908
May 10, 2000 (FR) ..... 00 05965

(51) Int. Cl.
*B65B 9/10* (2006.01)

(52) U.S. Cl. ..... 53/567; 53/434; 493/189; 493/194; 493/203; 493/341

(58) Field of Classification Search ..... 53/567, 53/434; 493/189, 194, 199, 203, 341
See application file for complete search history.

(56) References Cited

U.S. PATENT DOCUMENTS 2,679,280 A * 5/1954 Marsh ..... 156/515
3,035,381 A * 5/1962 Hosso ..... 53/568
3,239,993 A * 3/1966 Cherrin ..... 53/568
3,367,085 A * 2/1968 Parsons ..... 53/413
3,671,357 A * 6/1972 Trouilhet ..... 156/359
3,753,829 A * 8/1973 Freeman ..... 156/367
3,764,434 A * 10/1973 Bridenstine ..... 156/251
4,093,500 A * 6/1978 Browne ..... 156/510
4,104,108 A * 8/1978 Kishida et al. ..... 156/510
4,156,382 A * 5/1979 Baker ..... 493/86
4,545,177 A * 10/1985 Day ..... 53/434
4,941,310 A * 7/1990 Kristen ..... 53/512
5,682,727 A * 11/1997 Harte et al. ..... 53/434
5,816,990 A * 10/1998 Melville ..... 493/22
6,256,968 B1 * 7/2001 Kristen ..... 53/512

FOREIGN PATENT DOCUMENTS

GB 2275442 * 8/1994
WO 94/22723 10/1994

* cited by examiner

*Primary Examiner*—John Sipos
*Assistant Examiner*—Hermant M. Desai
(74) *Attorney, Agent, or Firm*—Dennison, Schultz, Dougherty & MacDonald

(57) ABSTRACT

The invention concerns packaging of products on sale outlets. It concerns a feed roll for heat sealing package tubing reel (11), comprising a body (3) provided with, in particular: means (4) supporting at least one reel (2) of package tubing (11); an outlet head (5) for the tubing including: at least an outlet window (10) for the tubing, means for cutting (15) the tubing, means for welding (16) the tubing, means (6) guiding the tubing between the reel (2) and the outlet head (5). The invention is useful for supplying and welding a heat sealing tubing in a fish market.

12 Claims, 3 Drawing Sheets

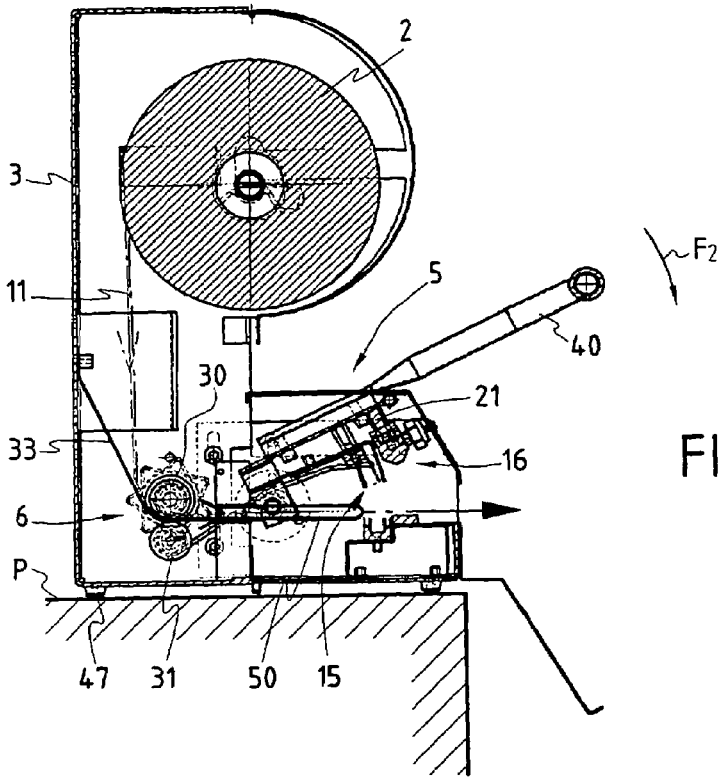
FIG.4
FIG.2
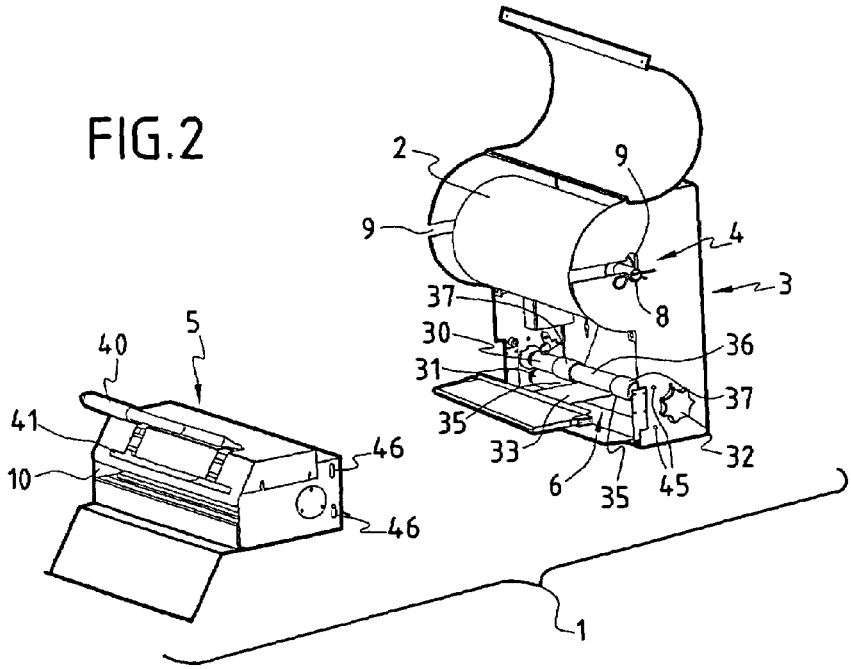

FEED ROLL FOR PACKAGE TUBING EQUIPPED WITH CUTTING AND SEALING MEANS

This application is a National Stage of PCT/FR01/00678 filed on Mar. 7, 2001.

BACKGROUND OF THE INVENTION

The present invention concerns the field of the packaging of products on their sale outlets and in particular food products sold retail.

The invention more particularly concerns the field of devices used to store the paper or film used to packaging and provide the trader with the paper when demanded. The invention also concerns the field of machines used to ensure a sealed closing of the packaging embodied.

In the field of the packaging of food products, the patent FR 2 775 252 proposed implementing a tubing constituted, at least in part, by a heat sealing material. This tubing, packed into rolls, is intended to be cut on the site of use to a length slightly larger than that of the product to be packed. One extremity of the tubing is then closed by heat sealing so as to embody a bag. Then, after introducing the product to be packed in the embodied bag, the other extremity of the tubing is heat-sealed so as to obtain an approximately sealed packaging.

The use of this packaging tubing is particularly useful for the packing of food products, such as fish or meat when these products are sold retail.

However, to the knowledge of the Applicant, there does not seem to be any device making it possible to use on easy fast sales outlets the packing or packaging tubing according to the patent FR 2 775 252.

In fact, the document WO 94 227 23 describes a packaging machine designed for the high rate production of bags from a heat sealing packaging tubing reel. This machine comprises a body provided with means for supporting a packaging tubing reel. This machine also comprises an outlet head for the tubing via a window and means for guiding the tubing between the reel and the outlet head. The outlet head includes means for welding and cutting the tubing, said means being mounted on a moving element whose to-and-fro movement is controlled by a motor element.

The means for activating the cutting and welding means described in this patent are relatively complex and onerous and definitely do not make it possible to embody a fully sealed packaging.

SUMMARY OF THE INVENTION

The present invention aims to resolve the drawbacks mentioned above and concerns a less heavy feed roll of simple design which is able to both make available to the user a heat sealing packaging tubing as the means required to embody a sealed packaging from this tubing.

So as to attain this objective, the invention concerns a feed roll for a heat sealing packaging tubing reel including a body provided in particular with:

means for supporting at least one packaging tubing reel, a tubing outlet head including:

at least one tubing outlet window, tubing cutting means tubing welding means, means for guiding the tubing between the reel and the outlet head, characterised in that the outlet head includes means for the simultaneous control of the cutting means and the welding means, said control means being formed by a handle and an oscillating arm bearing a portion of the cutting means and the welding means.

According to one characteristic, the invention aims to provide means for easily welding the final closing of the packaging obtained by means of the heat sealing tubing.

So as to attain this objective, the welding means are placed downstream of the cutting means with respect to the reeling off direction of the tubing.

According to a first embodiment variant, the outlet head includes a second window known as welding window adapted to allow from outside the head the introduction of a portion of at least one packaging intended to be welded by the welding means.

According to a second embodiment variant, the outlet head includes a non-return feeder placed between the cutting means and the welding means and intended to prevent access to the cutting means from outside the head via the outlet window.

The invention also concerns a feed roll which can be used according to various positions depending on the location where it is to be placed.

So as to attain this objective and according to one characteristic of the invention, the outlet head is movable and the body has means for fixing the head, said means being adapted so as to permit a mounting of the head according to at least two separate orientations.

BRIEF DESCRIPTION OF THE DRAWINGS

Miscellaneous characteristics appear in the description shown below with reference to the accompanying drawings which illustrate by way of non-restrictive examples the embodiments of the invention.

FIG. 2 is a perspective exploded view of the feed roll according to FIG. 1 in another use position.

FIG. 4 is a cross section illustrating another method for mounting the feed roll shown on FIG. 1.

DETAILED DESCRIPTION OF THE INVENTION

Figure 1:
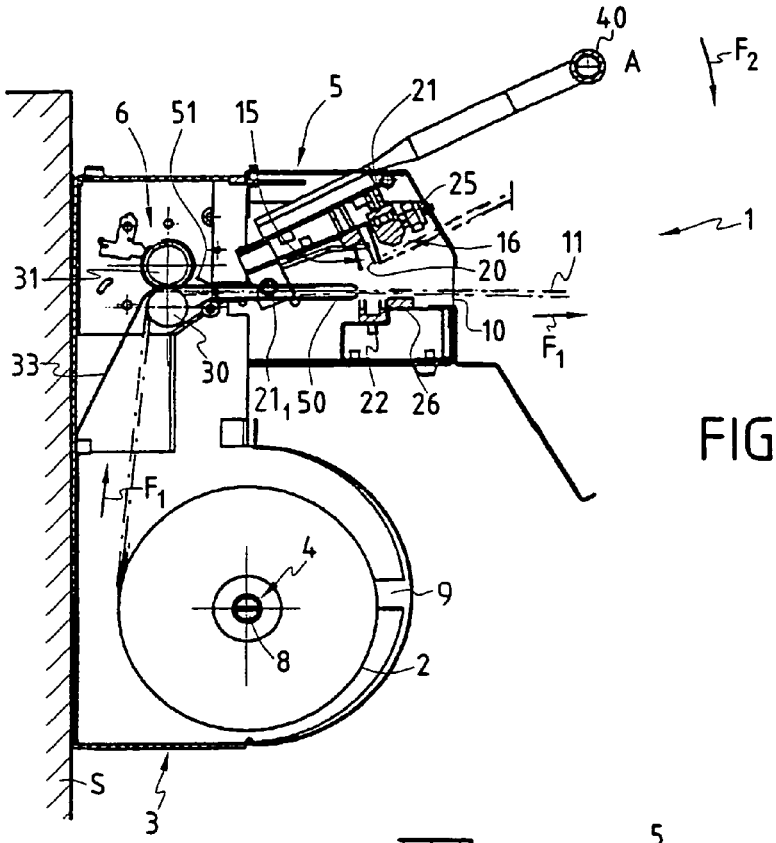
FIG. 1 is a cross section of a preferred embodiment of a feed roll according to the invention.

As shown more particularly on FIGS. 1 and 2, the feed roll of the invention denoted in its entirety by the reference 1 has been designed to receive at least one heat sealing packaging tubing reel 2, such as the one described in the patent FR 2 775 252. To this effect, the feed roll 1 includes a body 3 provided in particular with means 4 for supporting at least one packaging tubing reel 2. Moreover, the body 3 is equipped with an outlet head 5 for the tubing and means 6 for guiding the tubing between the reel 2 and the outlet head 5.

According to the example shown, the means 4 for supporting the reel 2 are formed by a spindle 8 intended to pass through the centre of the reel and come to rest in two cradles 9 fitted in the body 3 of the feed roll 1. Of course, the support means 4 could be embodied in another way, such as in the form of two rolls on which the reel 2 would come into support on its external surface.

The outlet head 5 includes at least one window 10 for the outlet of the tubing 11 derived from the reel 2, as shall appear subsequently. The head 5 also includes means 15 for cutting the tubing 11 and means 16 for welding the tubing 11.

For reasons to be explained subsequently, the cutting means 15 are preferably, but not exclusively, placed upstream of the welding means 16 with respect to the reeling off direction of the tubing 11, as indicated by the arrow $F_1$.

According to the example shown, the cutting means 15 include a mobile knife 20 borne by an arm 21 oscillating around a horizontal axis $\mathbf{21}_1$. The knife 20, with a length greater than or equal to the width of the packaging tubing 11, is designed to cooperate with a fixed cutting throat 22 having a length approximately equal to that of the knife 20. Thus, the knife 20 and the throat 22 form a sort of jaw able to be opened or closed by the movements of the oscillating arm 21 which thus bears a portion of the cutting means 15. It is to be noted that the arm 21 is preferably controlled on opening by elastic return means so as to be kept in an open position A, as shown on FIG. 1.

Similarly, the welding means 16 include a heating bar 25 mounted integral with the oscillating arm 21. The heating bar 25 is intended to cooperate with a counter-bar 26 so as to press an element or portion of the tubing 11 to be welded. The length of the heating bar 25 and that of the counter-bar 26 is greater than or equal to the width of the packaging tubing 11. According to the example shown, the heating bar 25 is mobile, whereas the counter-bar 26 is fixed. Thus, the oscillating arm 21 bears a portion of the welding means 16. Of course, it is possible to invert the positions of these two elements.

It is to be noted that the knife 20 and the throat 22, as well as the bar 25 and the counter-bar 26, are placed approximately transversally to the tubing 11 and more particularly to its reeling off direction $F_1$.

Finally, the feed roll 5 includes means 6 for guiding the tubing 11 between the reel 2 and the outlet head 5 and have been adapted so as to preferably, but not exclusively, bring the tubing 11 as far as downstream of the cutting means 15 with respect to the reeling off direction $F_1$ and directing the tubing 11 towards the outlet window 10.

Figure 3:
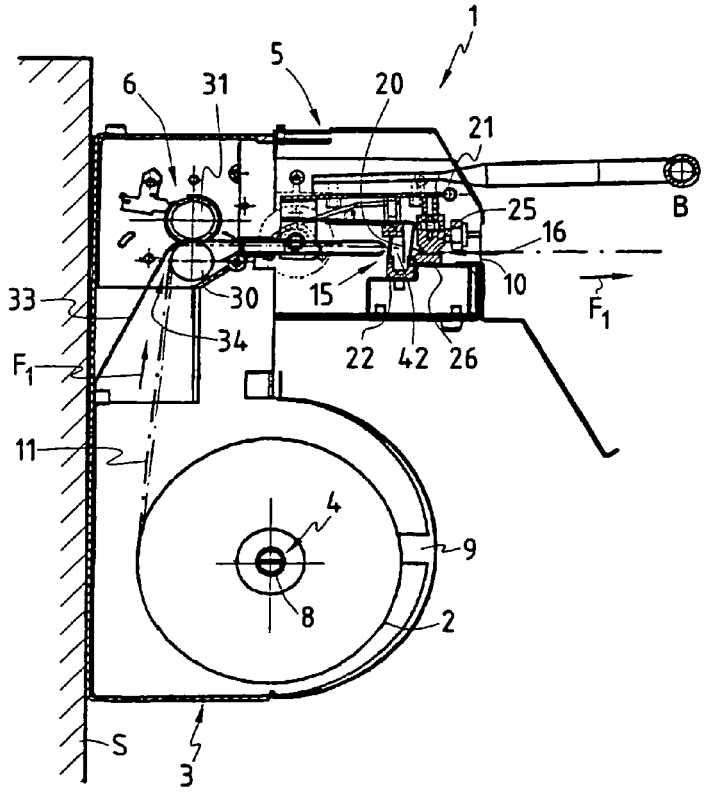
FIG. 3 is a view similar to that of FIG. 1 showing another phase for using the feed roll of the invention.

First of all, the guiding means 6 include a guiding roll 30 and a pressing roll 31 between which the packaging tubing 11 is intended to pass as shown by the dot-and-dash lines on FIGS. 1 and 3. The guiding means 6 further include means 32 for driving the guiding roll 30 so as to ensure a forward movement or reeling off the tubing 11 by placing the roll 30 in rotation. According to the example shown, the drive means are constituted by a handle 32 integral with the roll 30 and accessible from the outside of the body 3 of the feed roll 1.

Of course, the drive means 32 could be embodied in a form other than a handle, such as, but not exclusively, in the form of a controlled motor so as to function automatically or be controlled by a switch accessible from the outside of the body 3. Similarly, the means 32 could ensure a driving in rotation of the single pressing roll 31 or of the two guiding 30 and pressing 31 rolls simultaneously.

The guiding means 6 also include at least one guiding plate 33 extending upstream and downstream of the guiding 30 and pressing 31 rolls with respect to the reeling off direction $F_1$. This guiding plate 33 is adapted so as to guide the tubing in front of and behind the rolls 30 and 31, as well as during the time it is initially introduced between the rolls 30 and 31.

According to the example shown, it is to be noted that the guiding plate 33 is curved and forms an angle immediately in front of the guiding roll 30. The plate 33, together with the guiding roll 30, delimits an introduction zone 34 which forms a sort of tunnel in which the extremity of the tubing 11 is introduced when initially placing the reel 2.

According to a preferred characteristic of the invention, the guiding plate 33 extends between the guiding 30 and pressing 31 rolls. So that the rolls 30 and 31 carry out their guiding and drive functions, the plate 33 then defines at least one zone 35 in which the pressing 31 and guiding 30 rolls are able to guide and press the tubing 11 simultaneously.

According to the example shown, the plate 33 defines two lateral zones 35 for guiding the tubing 11 between the rolls 30 and 31. The guiding roll 30 then has a central recess 36 for passage of the plate 33, and, on both sides of this recess 36, a shoulder 37 for cooperating with the pressing roll 31 so as to ensure the guiding and driving of the tubing 11.

The feed roll of the invention is used as follows.

First of all, the reel 2 is placed and then the tubing 11 is passed between the rolls 30 and 31 by a user or operator. In order to do this, the user applies the tubing 11 against the plate 33 by making it move forwards as far as the roll 30. The tunnel shape of the introduction zone 34 then facilitates the tubing 11 being taken up by the guiding 30 and pressing 31 rolls.

The user then activates the control means 32 so as to have the tubing 11 move between the elements making up the cutting 15 and welding 16 means as far as the outlet window 10 from which the tubing can be directly pulled by the hand of the user.

When the user wishes to carry out a package from the tubing 11, he pulls a tubing length in keeping with the dimensions of the product to be packed. The operator then uses as a device for the simultaneous control of the cutting 15 and welding 16 means a handle 40 embodied at the extremity of the oscillating arm 21 and lowered by the operator in the direction of the arrow $F_2$. In this working position B shown on FIG. 3, the feed roll 1 firstly cuts the tubing 11 with the knife 20, and secondly seals with the heating element 16 the extremity of the cut tubing element. The heating element 16 is kept at a temperature corresponding to the melting temperature of at least one of the constituents of the tubing by a regulation system not forming part of the present invention.

With the feed roll 1 of the invention, the operator has therefore embodied from the tubing 11 and by a single manoeuvre of the oscillating arm 21 a sort of bag open on one side through which it is possible to introduce a product to be packed.

Once the product is inside this bag, the operator can reintroduce the non-closed extremity of the bag into the window 10 so as to place this open extremity at the level of the welding means 16. Then, via acting on the handle 40 in the direction of the arrow $F_2$, the user welds the fourth side of the bag and packs and seals the product placed inside the packaging obtained from the tubing 11. Thus, having regard to the positioning of the welding means 16 downstream of the cutting means 15 with respect to the direction $F_1$ of reeling off of the tubing, it is possible to weld a portion of the packaging introduced from outside the head 5.

According to a preferred embodiment of the feed roll of the invention, so as to ensure that the extremity of the tubing element reintroduced into the head 5 does not damage the extremity or edge 42 of the tubing derived from the reel and situated at the level of the cutting means 15, the outlet head 5 includes a second window 41 known as a welding head placed above the outlet head 10. This welding window 41 is adapted so as to allow introduction from outside the head of the portion of the packaging intended to be closed by the welding means 16.

Thus, during introduction of the packaging to be closed into the welding window 41, its extremity is situated above the extremity 42 of the tubing 11 derived from the reel 2 and is thus unable to damage it or push it back before or during the welding operation.

Figure 5:
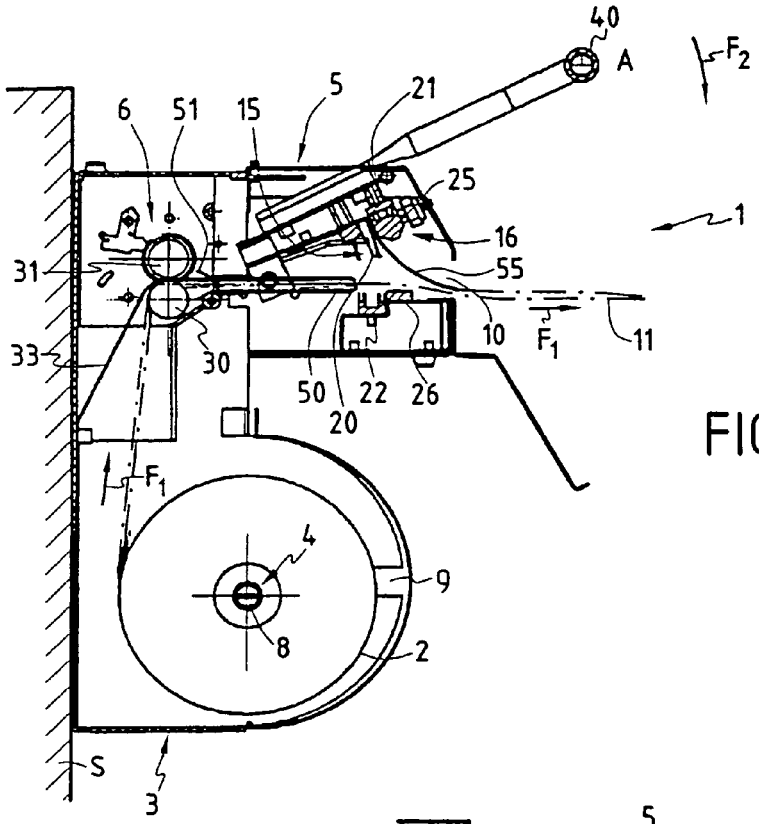
FIGS. 5 and 6 are views respectively similar to those on FIGS. 1 and 3 showing the phases for using another embodiment of the feed roll of the invention.
Figure 6:
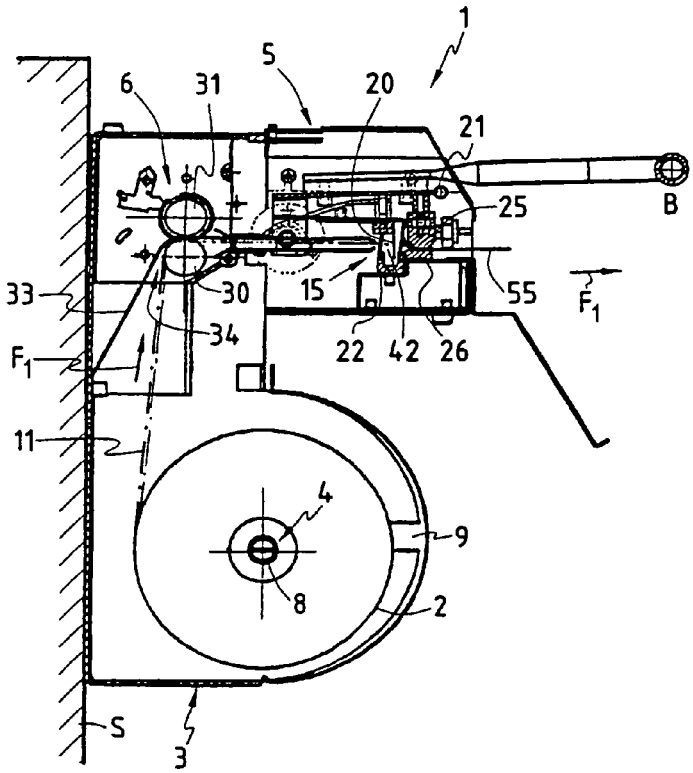

FIGS. 5 and 6 show a second embodiment variant of the feed roll on the invention and which differs from the embodiment variant described with respect to FIGS. 1 to 4 in that the cutting head 5 includes a non-return feeder 55 placed between the cutting means 15 and the welding means 16. One extremity of this feeder 55 is preferably secured to the arm 21 between the knife 20 and the welding bar 25, whereas the other extremity extends as far as the window 10, as shown on FIG. 5. The feeder 55 thus extends via its own weight at the level of the lower portion of the outlet window 10. Of course, it is possible to mount the feeder 55 between the cutting throat 22 and the counter-bar 26. The feeder 55 is made of a flexible material having a melting temperature higher than the welding temperature of the tubing 11 so as to avoid being altered by the welding means 15.

The feeder 55 provides a non-return function so as to prevent access to the cutting means 15 from the outside of the head 5 via the outlet window 10. In fact, having regard to the position of the non-return feeder 55, the tubing 11 originating from the reel 2 comes out of the window 10 by passing below the feeder 55 which contributes in guiding the tubing 11 as far as the window 10.

On the other hand, when a tubing extremity to be welded is reintroduced through the window 10, the feeder 55 limits this introduction so that the extremity of the tubing can only be reintroduced into the head 5 as far as the level of the welding means 16. In this way, the feeder 55 ensures that the reintroduced portion of the tubing is not cut again by the cutting means 16 and thus avoids the formation of waste which would be likely to damage a padding of the groove 22.

It is to be noted that the non-return feeder 55 is embodied in a material which does not alter the effectiveness of the welding means 16 so that the tubing originating from the reel 2 is fully welded when it is pressed between the heating bar 25 and the counter-bar 26 with insertion of the feeder 55 between the tubing 11 and the bar 25.

Having regard to the presence of the non-return feeder 55, it is then no longer necessary to provide at the level of the head 5 a second window, known as a welding window, situated above the outlet window 10, as shown in the first embodiment variant.

According to a preferred, but not exclusive, embodiment of the invention, the outlet head 5 is movable and the body 3 has means for fixing the head 5 which are adapted to allow a mounting of the head according to at least two separate orientations. Thus, according to the examples shown on FIGS. 1 and 4, the head 5 can be adapted on the body 3 so that the reel 2 is placed below the head, as shown on FIG. 1, or above the head 5, as shown on FIG. 4. The means for fixing the head 5 on the body 3 can be constituted by screws (not shown) intended to pass into additional perforations 45 and 46 fitted respectively on the body 3 and the head 5.

This faculty of mounting the outlet head 5 according to two separate orientations makes it possible to configure the feed roll of the invention according to the location where it is to be used.

Thus, when the reel is placed below the head 5, as shown on FIG. 1, the feed roll 1 can be applied on a support S, such as a wall or a lower part of a bench top. To this end, the body 3 includes means (not shown) for fixing or hooking to the support.

When the feed roll 1 is in the configuration shown on FIG. 4, with the reel being placed above the head 5, it is possible to place the feed roll on a bench top or a table P, the body 3 then being provided with feet 47.

So as to ensure optimum guiding of the tub ing 11, regardless of the installation orientation of the feed roll 1, the guiding means 6 include, downstream of the guiding roller 30 in the reeling off direction $F_1$ of the tubing 11, a tunnel 50 ensuring guiding of the tubing inside the head 5 as far as upstream of the cutting 15 and welding 16 means.

So as to facilitate introduction of the tubing, the tunnel 50 preferably has at its extremity orientated towards the rollers 30, 31 a flared entrance zone 51, as shown on FIG. 1.

The tunnel 50 advantageously defines, regardless of the orientation of the body 3, a support and guiding surface for the tubing 11 and guides the tubing so as to direct it towards the outlet window 10 of the outlet head 5.

When the head is able to be dismantled, the guiding means 6 and in particular the tunnel 50 are integral with the body 3. Moreover, the tunnel 50 is adapted to then extend inside the outlet head 5 as far as possible close to the cutting means 15.

According to the examples shown previously, the guiding means and more particularly the plate 33 and the rollers 30 and 31 are adapted to have the tubing take an angled path so as to reduce as much as possible the total spatial requirement of the feed roll 1. Of course, the path of the tubing could also be rectilinear.

According to the previously shown examples, the outlet head 5 is movable. Of course, it is possible that the outlet head is integral with the body 3 without being able to be dismantled.

Similarly, the guiding tunnel 50 is preferably used when the head can be dismantled, but this guiding tunnel could be used for a feed roll conforming to the invention not having any dismountable outlet head.

According to the examples shown, the means 40 for the simultaneous control of the cutting 15 and welding 16 means are formed by a handle and an oscillating arm. However, these control means 40 could be embodied in any other way and could be motorised.

The invention is not limited to the examples described and illustrated as various modifications can be made without departing from its context.

The invention claimed is:

1. Device for heat sealing packing tubing reel having a body, comprising:

means for supporting at least one reel of packing tubing;

an outlet head for the tubing including: at least one tubing outlet window; tubing cutting means; tubing welding means placed downstream of the tubing cutting means with respect to a reeling off direction F1 of the tubing so as to allow welding of at least one portion of a packing introduced from outside the head;

means for guiding the tubing between the reel and the outlet head, characterised in that the outlet head includes means for the simultaneous control of the cutting means and the welding means, said means being formed by a handle and an oscillating arm bearing a portion of the cutting means and of the welding means; and outlet head (5) includes a second welding window, said welding window adapted to allow introduction of at least one portion of a packing intended to be welded by the welding means from outside the head.

2. Device for heat sealing packing tubing reel having a body, comprising: means for supporting at least one reel of packing tubing; an outlet head for the tubing including: at least one tubing outlet window, tubing cutting means, tubing welding means placed downstream of the tubing cutting means with respect to a reeling off direction F1 of the tubing so as to allow welding of at least one portion of a packing introduced from outside the head (5);

means for guiding the tubing between the reel and the outlet head, characterised in that the outlet head includes means for the simultaneous control of the cutting means and the welding means, said means being formed by a handle and an oscillating arm bearing a portion of the cutting means and of the welding means, characterised in that the outlet head includes a non-return feeder placed between the cutting means and the welding means and intended to prevent access to the cutting means from outside the head via the outlet window.

3. The device according to claim 2, characterised in that the non-return feeder (55) extends as far as the window (10).

4. The device according to claim 2, characterised in that the non-return feeder (55) is made of a flexible material having a melting temperature greater than the temperature for welding the tubing.

5. The device according to claim 1 or 2, characterised in that the outlet head (5) is movable and in that the body (3) has means (45) for fixing the head (5), said means being adapted to allow a mounting of the head (5) along at least two separate orientations.

6. The device according to claim 1 or 2, characterised in that the cutting means (15) include a mobile knife (20) whose length is greater than or equal to the width of the packing tubing (11) and intended to cooperate with a fixed cutting throat (22).

7. The device according to claim 1 or 2, characterised in that the welding means (16) include a heating bar (25) and a counter-bar (26) between which an element to be welded is intended to be pressed.

8. The device according to claim 1 or 2, characterised in that the tubing guiding means (6) include:

a guide roll (30) and a pressing roll (31) between which the packing tubing (11) is to pass, means (32) for driving in rotation the guide roll (30) and/or the pressing roll (31), at least one guiding plate (33) extending upstream and downstream of the guide (30) and pressing (31) rolls and which is adapted to guide the tubing (11) in front of and behind the rolls (30, 31) and for guiding the tubing (11) when it is initially introduced between the rolls.

9. The device according to claim 8, characterised in that the guiding plate (33) extends between the guiding (30) and pressing (31) rolls and defines at least one zone (35) in which the guiding roll and pressing roll are able to cooperate simultaneously with the tubing (11).

10. The device according to claim 8, characterised in that the guiding means (6) include downstream of the guiding roll (30) in the direction $F_2$ of reeling off of the tubing a tunnel (50) ensuring a guiding of the tubing inside the outlet head (5) as far as upstream of the cutting (15) or welding (16) means.

11. The device according to claim 10, characterised in that the guiding tunnel has a flared entrance zone (51).

12. The device according to claim 10, characterised in that the tunnel (50) guides the tubing so as to direct it towards the outlet window (10) of the outlet head (5).

* * * * *